US005222097A

United States Patent [19]

Powell et al.

[11] Patent Number: 5,222,097

[45] Date of Patent: Jun. 22, 1993

[54] CHANNEL INDUCTION FURNACE BUSHING CAP COOLING DEVICE

[75] Inventors: William L. Powell, Waupaca, Wis.; William J. Duca, Boardman, Ohio

[73] Assignee: The Budd Company, Troy, Mich.

[21] Appl. No.: 803,210

[22] Filed: Dec. 6, 1991

[51] Int. Cl.[5] ..... H05B 6/16

[52] U.S. Cl. ..... 373/159; 373/160; 373/161; 373/165; 75/10.14

[58] Field of Search ..... 373/161, 165, 164, 160, 373/159; 75/10.14

[56] References Cited

U.S. PATENT DOCUMENTS

| | | | |
|---|---|---|---|
| 2,473,311 | 6/1949 | Tama et al. | 75/10.14 |
| 2,993,943 | 7/1961 | Cooke | 373/164 |
| 3,297,811 | 1/1967 | Kugler | 373/165 |
| 4,101,726 | 7/1978 | Griffiths | 373/165 |

*Primary Examiner*—Bruce A. Reynolds
*Assistant Examiner*—Tu Hoang
*Attorney, Agent, or Firm*—Harness, Dickey & Pierce

[57] ABSTRACT

A bushing cap used to close a gap in a liquid cooled bushing which surrounds a coil contained in a channel induction furnace. The coil, bushing and bushing cap is further surrounded by a thin refractory layer which is further surrounded by a molten metal loop. The bushing cap and bushing are liquid cooled to maintain a substantial uniform thermal gradient about the thin refractory layer surrounding the bushing and bushing cap. Preferably, this is accomplished by way of a bushing cap having a cooling member attached to a cover and mounted within the bushing gap. A cooling fluid is passed through both the cooling member of the bushing cap and cooling channels within the bushing to maintain a substantial uniform thermal gradient about the thin refractory layer.

19 Claims, 2 Drawing Sheets

CHANNEL INDUCTION FURNACE BUSHING CAP COOLING DEVICE

BACKGROUND OF THE INVENTION

1. Field of the Invention

This invention relates generally to induction furnaces and, more particularly, to a bushing cap for closing a gap in a bushing used to enclose an induction coil in a channel induction furnace.

2. Discussion of the Related Art

The principle of operation of a conventional channel induction furnace is similar to that of a transformer. An inductor coil is located around a laminated iron core which forms a core and coil assembly. This coil can be considered a primary winding. The material to be heated, typically an electrical conducting material such as metal is in the form of a metal loop surrounding the core and coil assembly and can be considered a single turn secondary winding. When an alternating voltage is applied to the coil, flux is induced into the laminated iron core. This flux induces a voltage, and a result thereof, a current exists in the metal loop. This current causes the metal loop to heat, melt and remain molten. To retain the molten metal in the loop, a refractory lining is provided about the loop. To keep the refractory from coming in contact with the core and coil assembly, a bushing is located about the core and coil assembly.

In order to achieve maximum efficiency, the molten metal loop must be closely positioned around the bushing. This close positioning requires a channel induction furnace design to have a minimal refractory thickness between the molten metal loop and the bushing. As such, it is well known in the art that a steep temperature gradient must be established in the refractory layer to achieve maximum refractory life. This is typically achieved by surrounding the core and coil assembly with a metallic liquid cooled bushing.

However, to prevent the liquid cooled bushing from also acting as a short circuited secondary winding, the bushing must have at least one gap placed along the entire length of the bushing. This is typically achieved by using an electrically non-conductive insulator in the bushing gap. Unfortunately the problem with using the non-conductive material is that it is also thermally less conductive than the metallic bushing. Therefore, the thermal gradient in the refractory layer is unfavorably altered about the bushing gap.

During normal operation of the furnace, molten metal penetrate the refractory layer around the molten metal loop. The penetrating metal forms a network or fin of molten metal in and about the refractory grains of the refractory layer. Over time, the molten metal network or fin progresses deeper into the refractory lining, thereby decreasing the thickness of the already thin refractory layer between the bushing and molten metal loop.

The rate and depth of the molten metal penetration is dependent on the thermal gradient in the refractory layer. Therefore, since the thermal gradient along the bushing gap is unfavorably altered by the material used to insulate the joint, the molten metal network or fin penetrates the refractory along the gap at a faster rate to greater depths than elsewhere around the bushing.

The molten metal network or fin may progress until it reaches the liquid cooled bushing or bushing ga insulator. If the molten metal reaches the liquid cooled bushing, it typically freezes on contact or slightly away from the bushing. However, because of the altered thermal gradient along the bushing gap and the increased rate and depth of molten metal penetration in this area of the refractory, most molten metal networks or fins will usually reach the insulating material within the gap instead of the liquid cooled bushing. When this happens, the molten metal does not freeze when it comes in contact with the bushing gap insulator. Rather, the molten metal thermally destroys the bushing insulator which then causes a molten metal run out at the bushing gap causing the furnace to be shut down.

What is needed then is a bushing cap to close the gap in an induction furnace bushing which will maintain substantially the same thermal gradient about the refractory layer as the liquid cooled bushing. Preferably, there should be no insulating material exposed to the penetrating molten metal network or fin. Accordingly, molten metal run outs should be prevented. Thus, an object of the prevent invention is to provide such a bushing cap.

SUMMARY OF THE INVENTION

In accordance with the present invention, a bushing cap is used for closing a gap in a bushing contained within an induction furnace. This is accomplished by positioning a thermal conductive cover relative to the bushing such that the cover extends along the entire length of the bushing gap. Provision is made for cooling the thermal conductive cover and insulating both the cover and the cooling means from the bushing.

In the preferred embodiment, a cooling member carrying a cooling fluid is brazed to the cover. Insulating material is positioned on the bushing along the bushing gap. The cooling member is then placed within the bushing gap so that the cover is positioned atop the insulating material. Insulating material is then placed along both sidewalls of the cooling member between the cooling member and the edges of the bushing gap.

Use of the present invention results in a substantially uniform thermal gradient about the refractory layer which encloses the bushing and bushing cap. As a result, the aforementioned problems associated with using the prior insulating approaches should be substantially eliminated.

BRIEF DESCRIPTION OF THE DRAWINGS

Still other advantages of the present invention will become apparent to those skilled in the art after reading the following specification and by reference to the drawings in which.

DETAILED DESCRIPTION OF THE PREFERRED EMBODIMENT

The following description of the preferred embodiments is merely exemplary in nature and is not intended to limit the invention or its application or uses.

Figure 1:
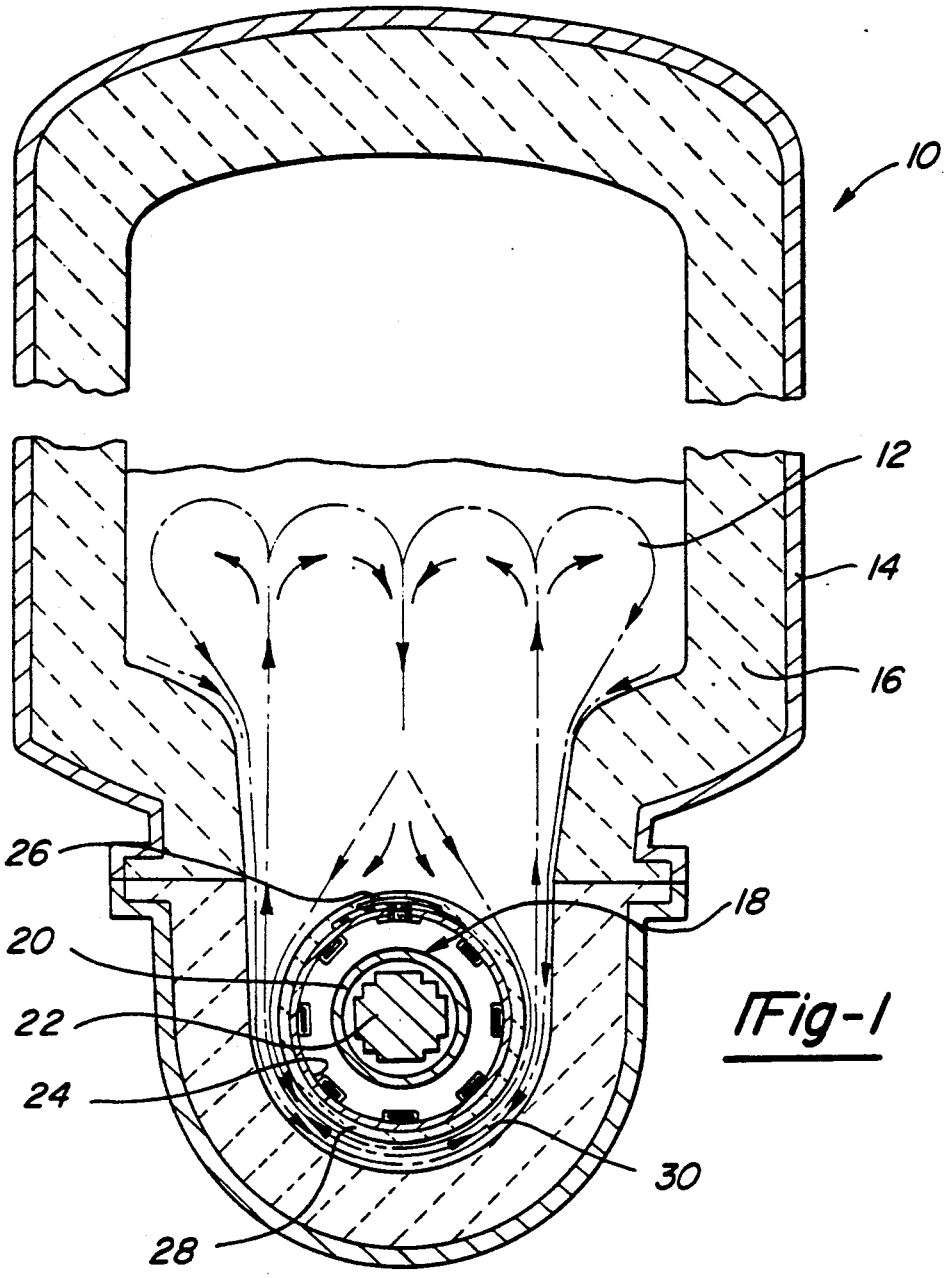
FIG. 1 is a cross sectional view of a channel induction furnace containing molten metal and a core and coil assembly including a coil and an iron core surrounded by a bushing with a bushing cap which is further enclosed by a thin refractory layer.

In FIG. 1 there is shown a typical channel induction furnace 10 containing molten metal 12. The induction furnace 10 contains an outer metal housing skin 14 which is lined with a thick refractory layer 16. Located at the lower portion of the furnace is a core and coil assembly 18 including a coil 20 and a laminated iron core 22. This core and coil assembly 18 is surrounded by a liquid cooled bushing 24 and bushing cap 26 which is further surrounded by a thin refractory layer 28. This thin refractory layer 28, together with the outboard thick refractory layer 16, defines a molten metal loop 30. The molten metal loop 30 acts as a single turn secondary winding which is magnetically coupled to the coil 20 contained within the core and coil assembly 18.

Figure 2:
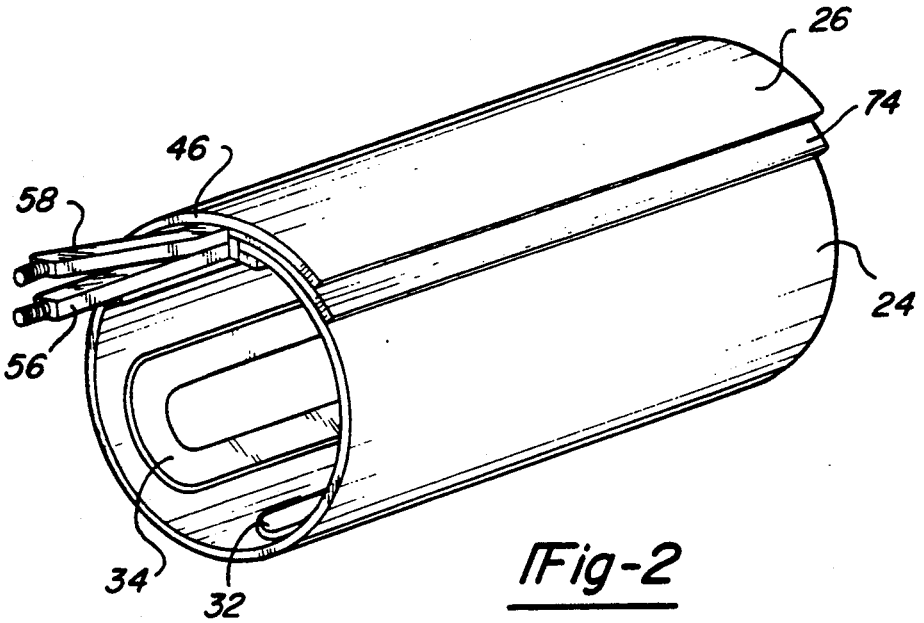
FIG. 2 is a perspective view of the bushing and bushing cap in one preferred embodiment containing both a liquid inlet port and a liquid outlet port located at one end of the bushing cap.

The coil 20 shown in FIG. 1 is located around the laminated iron core 22 which is surrounded by the liquid cooled bushing 24, shown more clearly in FIG. 2. By way of a non-limiting example, the coil 20 shown in FIG. 1 contains twenty-one (21) turns. The twenty-one (21) turn coil 20 and single turn metal loop 30 establishes a 21:1 ratio step down transformer which heats the metal 12 and maintains it in a molten condition.

Returning to FIG. 2, the bushing 24 enclosing the coil 22 is made of a thermally conductive material such as copper which is rolled into a cylindrical shape. However, one skilled in the art will readily recognize that the bushing 24 can be comprised of various other thermally conductive materials and can be formed into various other shapes such as a square or rectangle.

Figure 3:
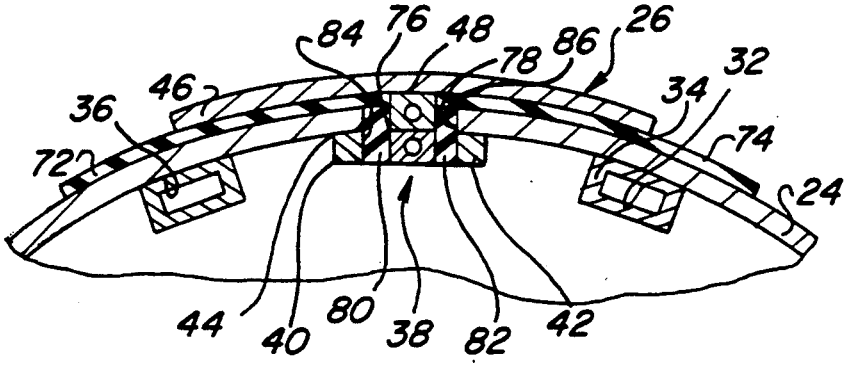
FIG. 3 is a partial cross sectional view of the bushing containing the bushing cap of FIG. 2.

Turning to FIG. 3, the bushing 24 contains cooling channels 32 which are located along the inside axial length of the bushing 24. The cooling channels 32, are made from rectangular copper tubing 34 which are affixed along silver brazed connections 36 to the inside surface of the bushing 24. The cooling channels 32 carry cooling fluid. This cooling fluid provides cooling to the bushing 24 as well a to the thin refractory layer 28 which encloses the bushing 24.

Since the bushing 24 is made of an electrically conductive material, a gap 38 must be maintained along the bushing length when the bushing is formed. This gap 38 keeps the bushing 24 from acting as a secondary winding which would be magnetically coupled to the coil 20. To maintain the bushing gap 38 and provide stability for the bushing cap 26, the bushing gap 38 is fitted with two stabilizing blocks 40 and 42, shown clearly in FIG. 3. The blocks 40 and 42 are made of copper and are affixed by silver brazed connections 44 to the inside surface of the bushing 24 adjacent to the edges defining the gap 38. However, one skilled in the art will find it apparent that the blocks 40 and 42 can be molded directly into the bushing or manufactured from various other materials. Once affixed, the stabilizing blocks 40 and 42 provide support and stability for the bushing cap 26 when placed within the gap 38.

Figure 4A:
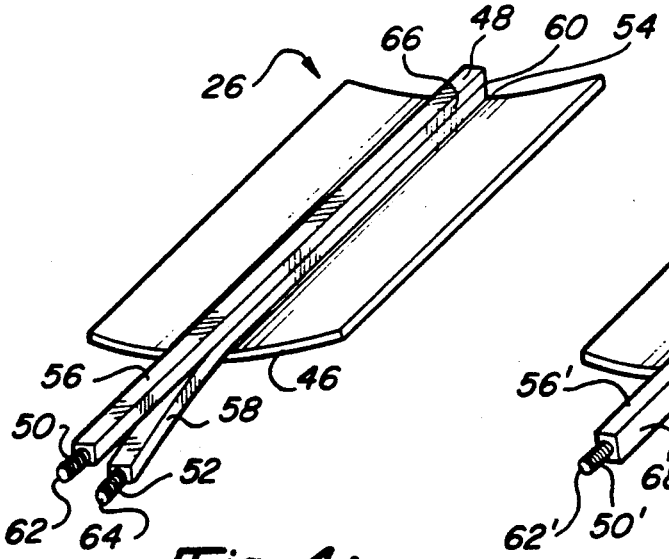
FIG. 4A is a perspective view of the underside of the bushing cap shown in FIG. 2.
Figure 4B:
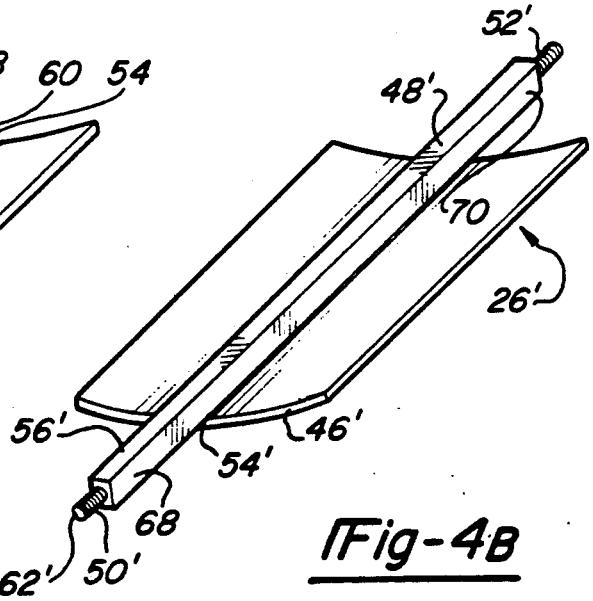
FIG. 4B is a perspective view of another embodiment of the bushing cap containing a liquid inlet port located at one end of the bushing cap and a liquid outlet port located at the opposite end of the bushing cap.

In FIGS. 1–4A, one preferred embodiment of the bushing cap 26 is shown, while in FIG. 4B an additional embodiment of the bushing cap 26′ is shown. The bushing caps 26 and 26′ in FIGS. 4A and 4B respectively, both contain thermally conductive covers 46 and 46′ formed from a thermally conductive material such as copper. The covers 46 and 46′ are both rolled into a semi-circular shape complementary to the outer diameter of the circular bushing 24 as shown in FIG. 2. However, it is readily apparent to one skilled in the art that the covers 46 and 46′ can be made of various other thermally conductive material and made to fit any particular bushing shape used, such as a square or rectangular shaped bushing.

As shown most clearly in FIG. 4A, there is illustrated a cooling member 48 for cooling the cover 46. Cooling member 48 is applicable for most induction furnace designs which only allow access to one end of the bushing 24. Thus, both the liquid inlet port 50 and the liquid outlet port 52 are located at one end of cooling member 48. The cooling member 48 is affixed along a silver brazed connection 54 to the cover 46 and is made of two pieces of rectangular copper tubing 56 and 58 which are also silver brazed together along connection 60. However, one skilled in the art will recognize that the cooling member 48 can be made of other thermally conductive materials and can be formed from different variations such as a one piece stock or molded into the cover 46.

The cooling member 48 further contains two cooling ducts 62 and 64. The ducts 62 and 64 run adjacent to one another along the length of the cooling member 48 and are connected together at the end 66 opposite the inlet port 50 and outlet port 52 to form a continuous U-shaped passageway. By way of a non-limiting example, a cooling fluid stored within a cooling source (not shown) is circulated through the input port 50 and down through the first duct 62. The circulating cooling fluid then returns to the cooling source by returning back through the second duct 64 and out through the outlet port 52.

In FIG. 4B, there is shown a cooling member 48′ made for other furnace applications which allow for access to both ends of the bushing 24. In this configuration, the cooling member 48′ is made from a one piece rectangular copper tubing 56′ which is silver brazed along connection 54′ to the inside of the cover 46′. However, it will be apparent to one skilled in the art that the member 48′ can be made of different materials and formed from different variations such as being molded directly into the cover 46′. The first end 68 of the member 48′ contains a liquid inlet port 50′ and the second end 70 contains a liquid outlet port 52′. Both the liquid inlet port 50′ and liquid outlet port 52′ are connected to one cooling duct 62′ which passes through the entire length of the member 48′. By way of a non-limiting example, the cooling fluid stored within the cooling source (not shown) is circulated through the inlet port 50′ and down through duct 62′. The fluid then exits out of the outlet port 52′ and returns to the cooling source.

Returning to FIG. 3, since the bushing cap 26 in the preferred embodiment is made of copper, the cap 26 must be insulated from the bushing 24 to prevent the bushing from acting as a short circuited secondary winding. By way of a non-limiting example, this is achieved by placing insulating plates 72 and 74, typically made of a rubberized asbestos material such as klingerit, on the top of copper bushing 24 along the bushing gap 38. The bushing cap 26 is then positioned with the cooling member 48 placed within the gap 38. This allows the cover 46 to extend along the entire length of the gap 38 and lay atop the insulating plates 72 and 74. The insulating plates 72 and 74 extend up to the cooling member sidewalls 76 and 78 and out from the cover 46, as shown in FIG. 2. This ensures that the cover 46 is insulated from the bushing 24. Insulating spacers 80 and 82, also made of a rubberized asbestos material such as klingerit, are positioned between the sidewalls 76 and 78 of the cooling member 48, the abutting edges 84 and 86 of the gap 38, and inner faces of the stabilizing blocks 40 and 42. The bushing cap 26 as well as the insulating plates 72 and 74 and insulating spacers 80 and 82 are all then held firmly in place by the radial inward force of the rolled bushing 24 and the thin refractory layer 28.

The bushing 24 and bushing cap 26 are then both cooled by circulating the cooling fluid from the cooling source through both the cooling channels 32 of the bushing 24 and the cooling ducts 62 and 64 of the cooling member 48. This circulating cooling fluid insures that the thermal gradient of the thin refractory layer 28 about the bushing 24 and bushing cap 26 is maintained substantially uniform, thereby preventing uneven wear in the refractory layer 28 and molten metal run outs through the bushing gap 38.

The foregoing discussions discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A bushing cap for closing a bushing gap in a bushing, said bushing and bushing cap surrounding an induction coil in a channel induction furnace, said bushing cap comprising:

a thermally conductive cover positioned relative to the bushing such that the cover extends along a length of the bushing gap;

cooling means for cooling the cover, said cooling means being in thermal contact with the cover and operable to be inserted within the bushing gap to substantially close the bushing gap; and insulating means for insulating the cover and the cooling means from the bushing.

2. The bushing cap of claim 1 wherein the cooling means comprises a cooling member carrying a cooling fluid.

3. The bushing cap of claim 1 wherein the bushing cap is made of copper.

4. The bushing cap of claim 2 wherein a first end of the cooling member includes both a liquid inlet port and a liquid outlet port.

5. The bushing cap of claim 4 wherein the liquid inlet port is connected to a first duct and the liquid outlet port is connected to a second duct, the first and second ducts running adjacent each other and being connected together at a second end of the cooling member.

6. The bushing cap of claim 2 wherein a first end of the cooling member includes a liquid inlet port and a second end of the cooling member includes a liquid outlet port.

7. The bushing cap of claim 6 wherein the liquid inlet port is joined to the liquid outlet port through a single axial duct.

8. In an induction furnace including an induction coil, said induction coil being surrounded by a circular bushing containing a bushing gap extending along an entire length of the bushing and a bushing cap closing said bushing gap, said bushing and bushing cap being surrounded by a refractory layer, an improved bushing cap comprising:

a semi-circular cover positioned relative to the circular bushing such that the cover extends along the entire length of the bushing gap;

a cooling member having an elongated block shape and carrying a cooling fluid, said cooling member being affixed along a length of the cooling member to a concave side of the semi-circular cover, said cooling member being inserted within the bushing gap to substantially close the bushing gap;

insulating plate means for insulating the concave side of the cover from the bushing; and a first insulating spacer and a second insulating spacer, the first insulating spacer being positioned between a first sidewall of the cooling member and a first edge defining the bushing gap in the bushing, the second insulating spacer being positioned between a second sidewall of the cooling member and a second edge defining the bushing gap in the bushing.

9. The bushing cap of claim 2 wherein the cooling member is affixed along a length of the cooling member to the cover.

10. The bushing cap of claim 2 wherein the bushing is circular and the cover has a semi-circular shape generally complementary to an outside of a circular bushing.

11. The bushing cap of claim 10 wherein the cooling member has an elongated block shape and is affixed along a length of the cooling member to a concave side of a semi-circular cover.

12. The bushing cap of claim 2 wherein the insulating means comprises a first insulating plate and a second insulating plate, the first insulating plate being positioned between a portion of the cover on one side of the cooling member and the bushing, the second insulating plate being positioned between a portion of the cover on an opposite side of the cooling member and the bushing.

13. The bushing cap of claim 12 wherein the insulating means further comprises a first insulating spacer and a second insulating spacer, the first insulating spacer being positioned between a first sidewall of the cooling member and a first edge defining the bushing gap in the bushing, the second insulating spacer being positioned between a second sidewall of the cooling member and a second edge defining the bushing gap in the bushing.

14. A method for closing a bushing gap in a bushing using a bushing cap, said bushing and bushing cap surrounding an induction coil in an induction furnace, said method comprising the steps of:

affixing a cooling member to a thermal conductive cover, said cooling member and cover being part of the bushing cap;

positioning insulating means between the bushing and bushing cap to insulate the cover said the cooling member from the bushing;

inserting the cooling member within the bushing gap to substantially close the bushing gap, wherein the along a length of the bushing gap; and cooling the cover.

15. The method of claim 14 wherein the step of affixing the cooling member to the cover includes the step of brazing the cooling member to the cover.

16. The method of claim 14 wherein the step of positioning the insulating means includes the steps of placing a first insulating plate on the bushing adjacent to a first edge defining the bushing gap and placing a second insulting plate on the bushing adjacent to a second edge defining the bushing gap.

17. The method of claim 16 wherein the step of inserting the cooling member within the bushing gap to substantially close the bushing gap, includes the step of positioning the cover on the first and the second insulating plates.

18. The method of claim 17 wherein the step of inserting the cooling member within the bushing gap further includes the steps of inserting a first insulating spacer between a first sidewall of the cooling member and the first edge defining the bushing gap; and inserting a second insulating spacer between a second sidewall of the cooling member and the second edge defining the bushing gap.

19. The method of claim 14 wherein the step of cooling the cover includes passing a cooling fluid through the cooling member.

* * * * *